US005182893A

United States Patent [19]

Goodworth

[11] Patent Number: 5,182,893

[45] Date of Patent: Feb. 2, 1993

[54] PANEL, CLIP AND METHOD OF MOUNTING PANEL

[76] Inventor: John P. Goodworth, 7617 Stone Rd., Medina, Ohio 44256

[21] Appl. No.: 850,580

[22] Filed: Mar. 13, 1992

Related U.S. Application Data

[62] Division of Ser. No. 564,195, Aug. 8, 1990, Pat. No. 5,123,225.

[51] Int. Cl.[5] ..... E04B 1/00

[52] U.S. Cl. ..... 52/745.05

[58] Field of Search ..... 52/745, 747, 741

[56] References Cited

U.S. PATENT DOCUMENTS

| | | | |
|---|---|---|---|
| 1,997,607 | 4/1935 | Strom . | |
| 2,071,865 | 2/1937 | Parsons . | |
| 2,282,624 | 5/1942 | Upson et al. . | |
| 2,490,663 | 12/1949 | Van Uum et al. . | |
| 2,807,993 | 10/1957 | Ericson . | |
| 3,729,884 | 5/1973 | Dunn et al. | 52/747 |
| 4,089,146 | 5/1978 | Martinez . | |
| 4,344,267 | 8/1982 | Sukolics . | |
| 4,471,593 | 9/1984 | Ragland . | |
| 4,520,607 | 6/1985 | Suckow . | |
| 4,596,094 | 6/1986 | Teller et al. . | |
| 4,621,473 | 11/1986 | Wendt . | |
| 4,640,064 | 2/1987 | Goodworth, II . | |
| 4,742,662 | 5/1988 | Smith . | |
| 5,123,225 | 6/1992 | Goodworth | 52/127.8 X |

FOREIGN PATENT DOCUMENTS

| | | |
|---|---|---|
| 2847007 | 4/1980 | Fed. Rep. of Germany . |
| 1381143 | 2/1964 | France . |
| 870849 | 6/1961 | United Kingdom . |

*Primary Examiner*—Richard E. Chilcot, Jr.
*Assistant Examiner*—Creighton Smith
*Attorney, Agent, or Firm*—Tarolli, Sundheim & Covell

[57] ABSTRACT

A panel assembly includes a resiliently deflectable panel and a plurality of retainer clips. The panel includes a relatively thick rectangular base section and a relatively thin rectangular lip section which extends outwardly from the periphery of the base section. The retainer clips are connected with the base section and cooperate with the lip section of the panel to engage a support structure to hold the panel in place. To mount the panel in the support structure, the panel is resiliently flexed. The panel is then released and its natural resilience causes a retainer clip to engage the support structure to hold the panel against movement relative to the support structure. A disengagement tool may advantageously be inserted between the panel and the support structure to apply force against the retainer clip and to resiliently flex the panel to disengage the retainer clip from the support structure.

10 Claims, 5 Drawing Sheets

PANEL, CLIP AND METHOD OF MOUNTING PANEL

BACKGROUND OF THE INVENTION

The present invention relates to a new and improved panel assembly, a retainer or mounting clip, and a method by which the panel assembly is installed in a support structure.

Resilient retainer clips have previously been used to connect panels with a support structure. As the panels are connected with the support structure, the retainer clips are resiliently deflected. Such a panel mounting arrangement is disclosed in U.S. Pat. Nos. 4,471,593 and 4,596,094. Various known ways of mounting panels are disclosed in U.S. Pat. Nos. 4,742,662; 4,640,064; 4,621,473; 4,520,607; 4,344,267; 4,089,146; 2,807,993; 2,490,663; 2,282,624; 2,071,865; and 1,997,607. In addition, various ways of mounting panels are disclosed in German Offenlegungsschrift No. 2,847,007; British Patent No. 870,849 and French Patent No. 1,381,143.

SUMMARY OF THE INVENTION

The present invention relates to a new and improved panel assembly, retainer clip, and method of mounting the panel assembly. The panel assembly includes a resiliently deflectable panel. One specific embodiment of the panel a rectangular base section and a rectangular lip section which extends outwardly from the base section. An improved retainer clip is mounted at each of the corners of the base section.

When the panel assembly is to be installed in a support structure, the retainer clips are moved into engagement with the support structure with minimal deflection of the retainer clips. This is accomplished by resiliently flexing the panel to position the retainer clips relative to the support structure. The resiliently deflectable panel is released and its own natural resilience moves the retainer clips into engagement with the support structure. As this occurs, there may be some deflection of the retainer clips, themselves. Thus, the panel assembly is mounted in the support structure by deflecting the panel itself and, to a lesser extent, the retainer clips.

Accordingly, it is an object of this invention to provide a new and improved panel which is mounted in a support structure by resiliently flexing the panel.

Another object of this invention is to provide a new and improved panel assembly which includes a plurality of retainer clips disposed at corner portions of a rectangular panel.

Another object of this invention is to provide a new and improved retainer clip for connecting a corner of a panel with a support structure.

BRIEF DESCRIPTION OF THE DRAWINGS

The foregoing and other objects and features of the present invention will become more apparent upon a consideration of the following description taken in connection with the accompanying drawings, wherein.

DESCRIPTION OF ONE SPECIFIC

Preferred Embodiment of the Invention

General Description

Figure 1:
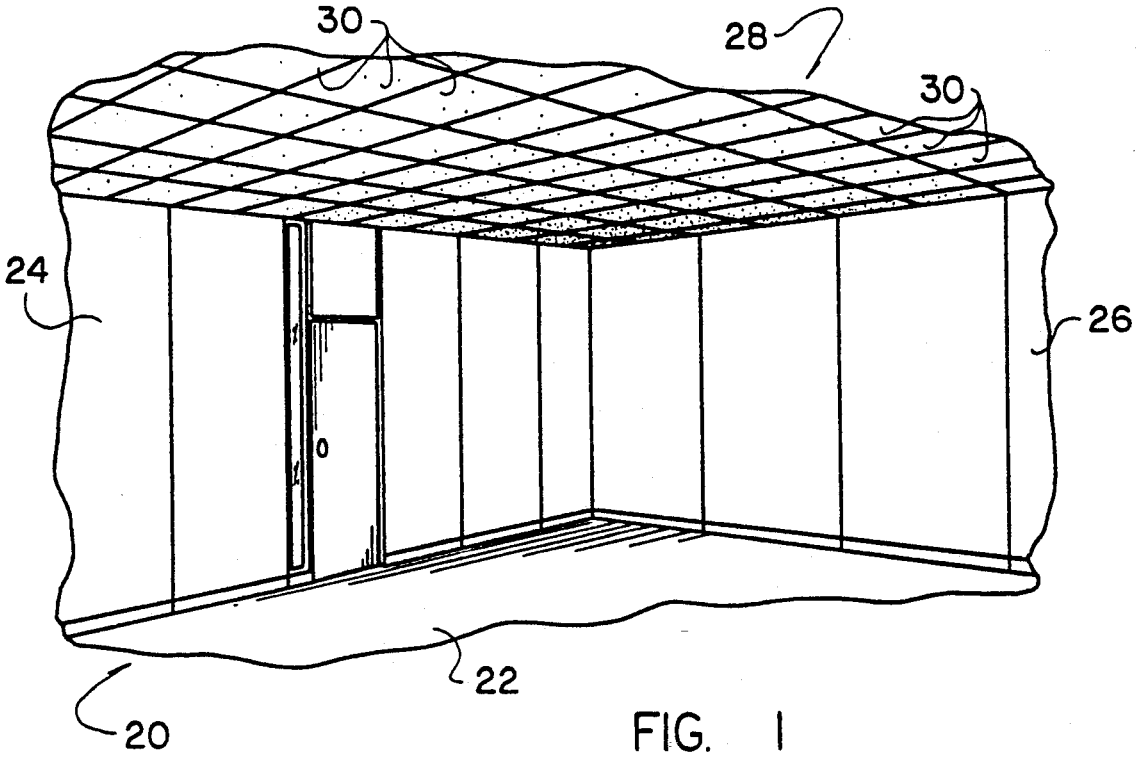
FIG. 1 is a schematic pictorial illustration of a room having a suspended ceiling with panel assemblies constructed and mounted in accordance with the present invention.

A room 20 (FIG. 1) in a building includes a floor 22, walls 24 and 26, and a suspended ceiling 28. The suspended ceiling 28 includes rectangular panel assemblies 30 which are constructed and installed in accordance with the present invention. Although the panel assemblies 30 have been illustrated in FIG. 1 in association with the suspended ceiling 28, it is contemplated that the panel assemblies could be used in association with walls, furniture or other support structures if desired.

Figure 2:
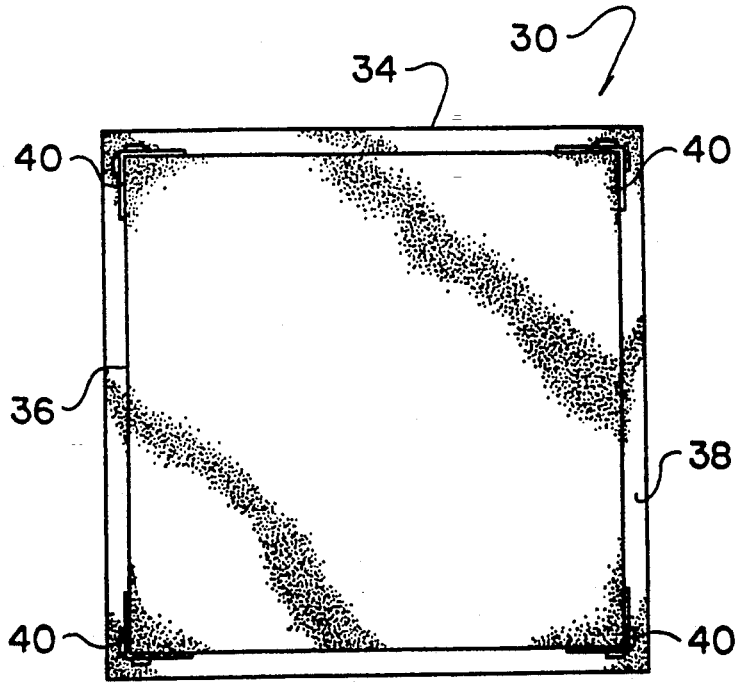
FIG. 2 is a top plan view of a panel assembly used in the suspended ceiling of FIG. 1.

The panel assembly 30 includes a resiliently deflectable panel 34 (FIG. 2). The panel 34 includes a rectangular base section 36 and a continuous rectangular lip section 38 which extends outwardly from the base section 36. A plurality of retainer clips or elements 40 are mounted at corner portions of the panel 34. Each of the retainer clips or elements 40 is mounted on the corner portion of the base section 36 (FIG. 3) of the panel 34.

The retainer clip 40 has resiliently deflectable latch teeth 44 and 46 (FIGS. 4, 5 and 6) which overlie the lip section 38 (FIG. 3) of the panel 34. The latch teeth 44 and 46 cooperate with the lip section 38 of the panel 34 to grip a support structure between the latch teeth and the lip 38 of the panel 34.

Figure 4:
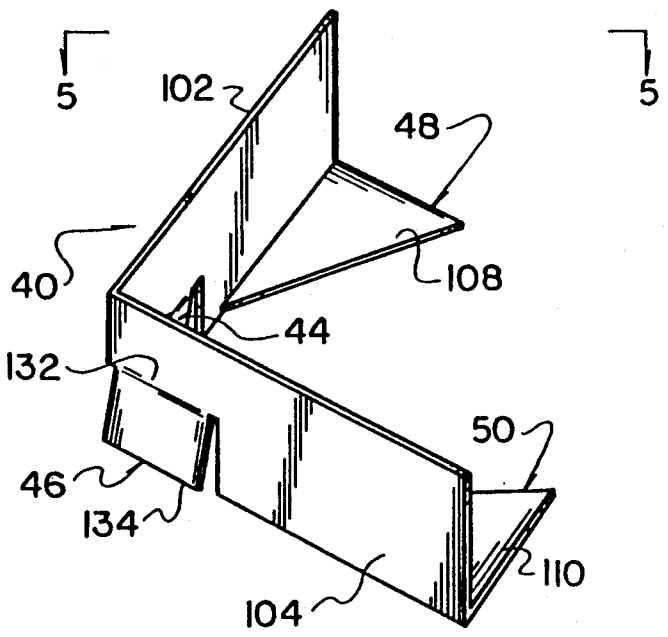
FIG. 4 is a pictorial illustration of one of the retainer clips of the panel assembly of FIG. 2.
Figure 5:
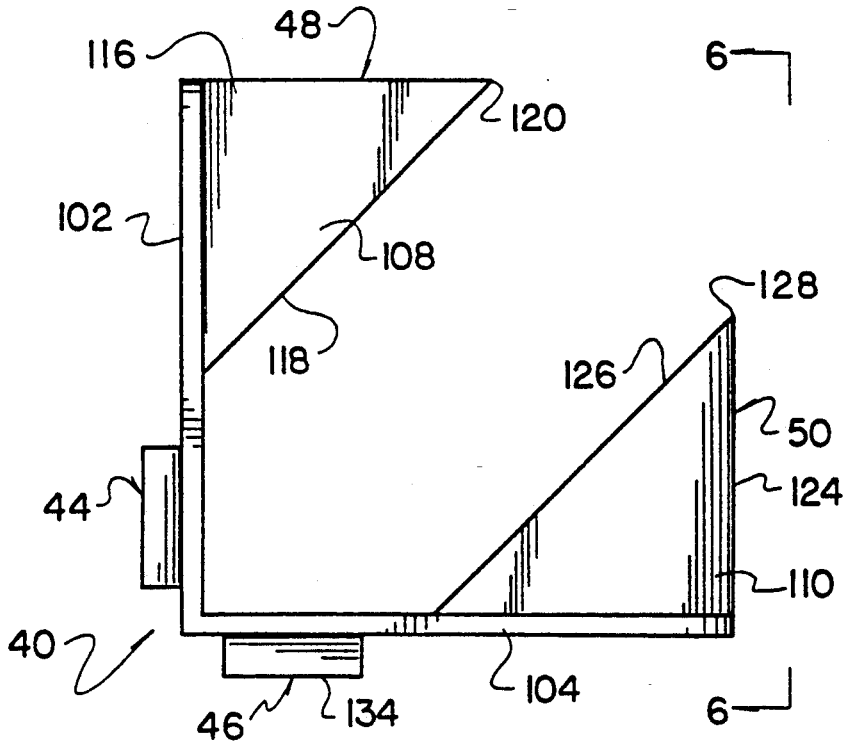
FIG. 5 is a top plan view, taken generally along the line 5—5 of FIG. 4, further illustrating the construction of the retainer clip.
Figure 6:
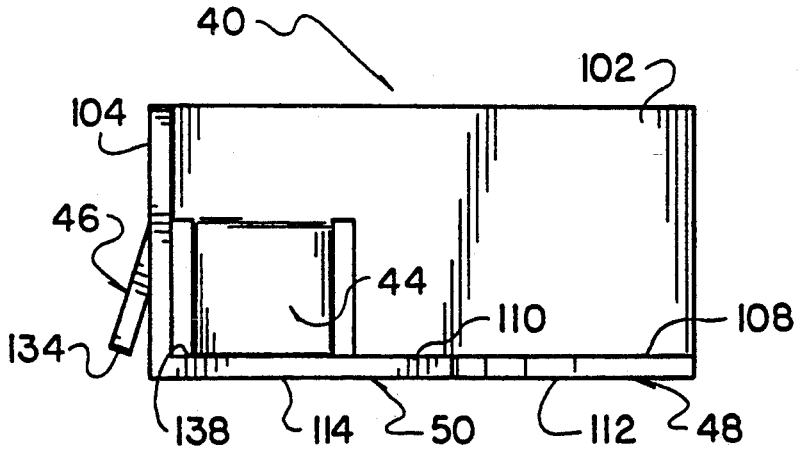
FIG. 6 is a side elevational view, taken generally along the line 6—6 of FIG. 5, further illustrating the construction of the retainer clip.

In addition to the latch teeth 44 and 46, the retainer clip 40 includes a pair of mounting teeth 48 and 50 (FIGS. 4, 5 and 6). The mounting teeth 48 and 50 penetrate the material of the base section 36 of the panel 34 at a junction between the base section and the lip section 38 of the panel. The mounting teeth 48 and 50 hold the retainer clip 48 against movement relative to the panel 34.

Figure 7:
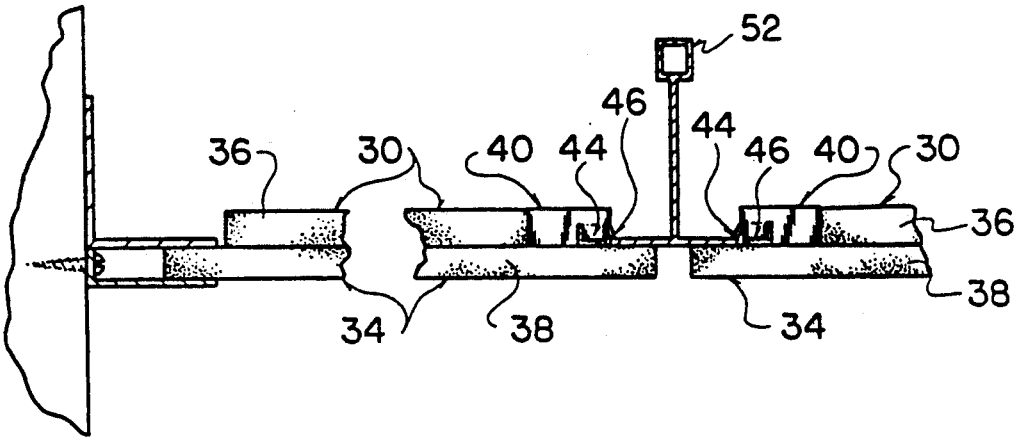
FIG. 7 is a fragmentary sectional view of the suspended ceiling of FIG. 1 and illustrating the manner in which a pair of the panel assemblies of FIG. 2 are connected with a support structure.
Figure 8:
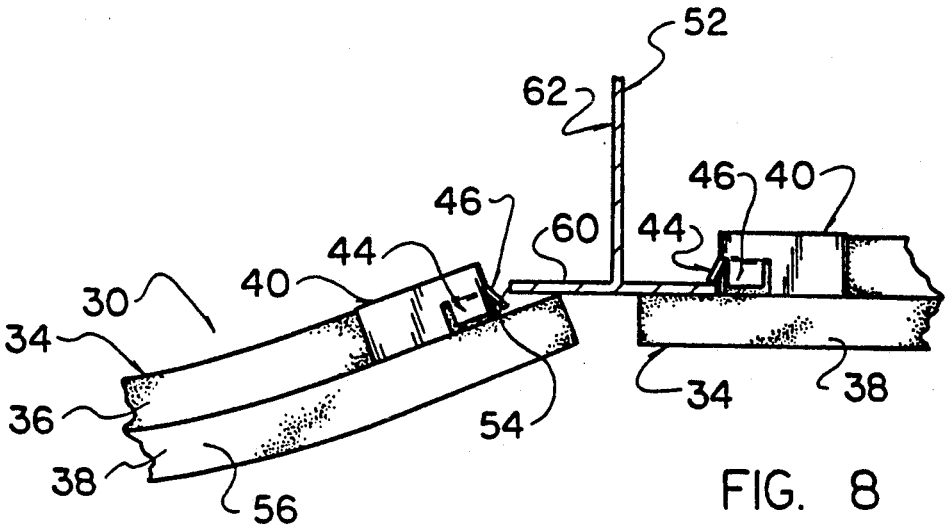
FIG. 8 is an enlarged fragmentary sectional view depicting the manner in which a panel assembly is resiliently flexed relative to the support structure of FIG. 7 by deflecting a corner portion of the panel assembly.
Figure 9:
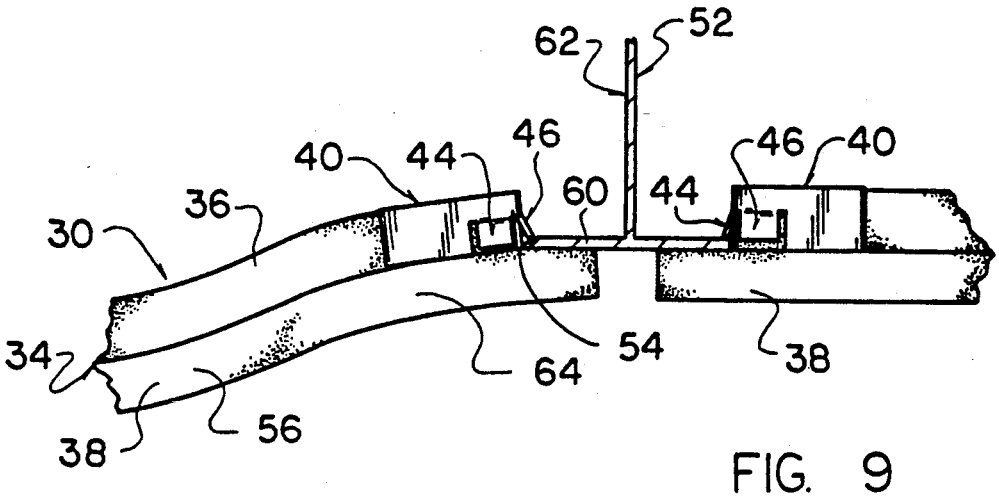
FIG. 9 is a fragmentary sectional view, generally similar to FIG. 8, illustrating the manner in which a rectangular lip portion of the panel assembly is resiliently flexed by engagement with the support structure.

When the panel assembly 30 is to be mounted in a support structure 52 (FIG. 7), the panel assembly 30 is first moved into alignment with an opening 54 (FIG. 8) in tho support structure The panel 34 is then resiliently flexed (FIGS. 8 and 9). The panel 34 is resiliently flexed by manually applying force to the panel. By resiliently flexing the panel 34, the retainer clips 40 at the corner portions of the panel 34 can be moved into engagement with the support structure 52 with simultaneous deflection of the retainer clips to a lesser extent than would be required in the absence of flexing of the panel 34.

When a panel assembly 30 is manually flexed, a corner portion of the panel 34 is resiliently deflected upwardly relative to the remainder of the panel 34, in the manner indicated schematically at 56 in FIG. 8. The upward deflecting of the corner portion of the panel 34 moves the latch tooth 46 on the retainer clip 40 toward a horizontal outwardly extending flange 60 on a tee or grid member 62 of the support structure 52. Although the corner portion of the panel 34 is resiliently deflected upwardly, the remainder of the panel remains substantially horizontal.

The panel 34 is then manually moved upwardly so that a leading or upper end portion of the lip section 38 abuttingly engages the support structure flange 60. Continued upward movement of the panel 34 resiliently flexes the lip section 38 (FIG. 9) of the panel 34. This results in the lip section 38 being deflected downwardly as the mounting tooth 46 on the retainer clip 40 approaches the support structure flange 60. The downward deflection of the lip section 38 is illustrated schematically at 64 in FIG. 9. The base and lip sections 36 and 38 of the panel 34 are both flexed upwardly, in the manner indicated at 56 in FIG. 9, while the lip section 38 is deflected downwardly by the support structure flange 60.

After the lip section 38 of the panel 34 has been deflected, the upper side surface of the lip section is slid along the bottom surface of the support flange 60 to resiliently flex the latch tooth 46 and move the latch tooth over the upper surface of the support structure flange. The panel 34 is then released and the natural resilience of the panel causes the panel to spring back and eliminate the bends 56 and 64. The support structure flange 60 is firmly gripped between the latch tooth 46 of the retainer clip 40 and the lip section 38 of the panel 34 when the panel has returned to its initial or undeflected condition (FIG. 10).

Figure 10:
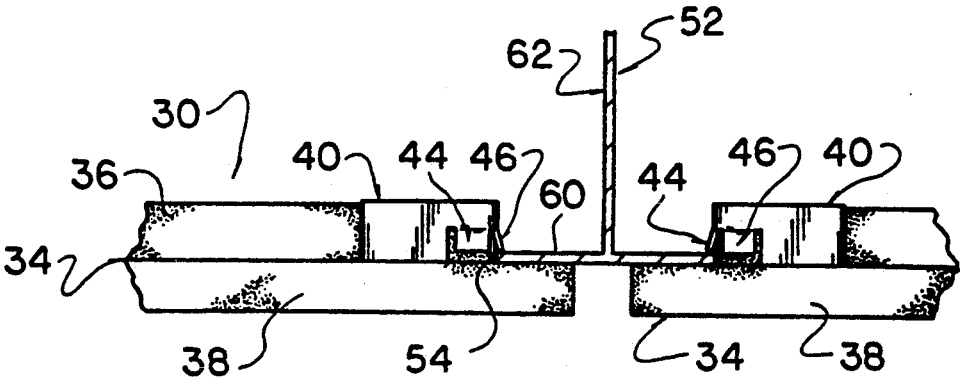
FIG. 10 is a fragmentary sectional view, generally similar to FIGS. 8 and 9, illustrating the manner in which a retainer clip of the panel assembly engages the support structure after the panel assembly has returned to its undeflected condition.

Although only the method of engagement of the latch tooth 46 with the support structure flange 60 has been illustrated in FIGS. 8-10, it should be understood that the latch tooth 44 moves into engagement with an adjacent flange of the support structure 52 at the same time that the latch tooth 46 engages the flange 60. Thus, the resilient latch teeth 44 and 46 are disposed on an outer corner portion of the panel 34 and simultaneously engage an inner corner portion of the support structure 52. The inner corner portion of the support structure 52 is formed by intersecting flanges 60 of grid or tee members 62. By resiliently deflecting the panel 34, the resilient latch tooth 44 is slipped into engagement with the flange 60 of the grid at the same time and in the same manner as previously described in conjunction with the latch tooth 46.

Although the support structure 52 is the grid for a suspended ceiling, it is contemplated panel assemblies, having the same general construction as the panel assembly 30, could be associated with many different types of support structures. For example, the support structure could be part of a wall or room divider. In this case, the panel assembly 30 would be inserted in a vertical rather than a horizontal orientation. It is also contemplated that the support structure could be an article of furniture, such as a desk or cabinet. Regardless of the type of support structure, the retainer clip teeth 44 and 46 would be engaged with the support structure by resiliently flexing the panel in the manner previously described.

Figure 11:
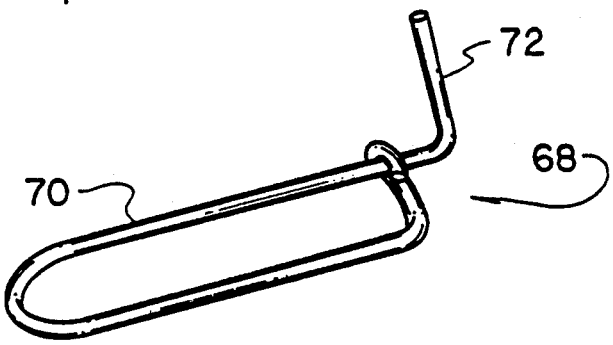
FIG. 11 (on sheet 4 of the drawings) is a pictorial illustration of a disengagement tool used to disengaged an installed panel assembly from the support structure.

It is contemplated that it may be desired to disengage the panel assembly 30 from the support structure 52 after the panel assembly has been installed for a period of time. This is accomplished by again flexing the panel assembly 30 to disengage the retainer clip 40 from the support structure 52. A disengagement tool 68 (FIG. 11) is provided to assist in flexing of the panel assembly 30. The disengagement tool 68 has a handle portion 70 and an actuator arm 72 which extends perpendicular to the handle portion 70.

Figure 12:
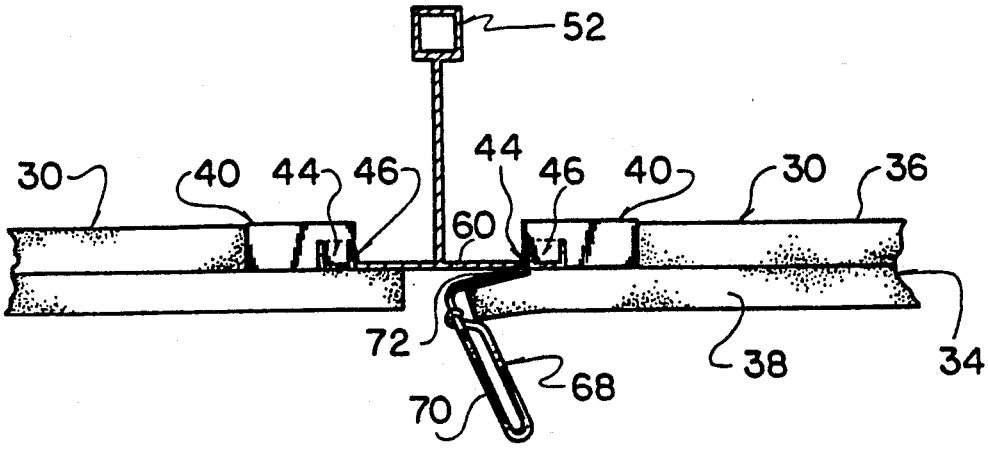
FIG. 12 is a fragmentary sectional view, generally similar to FIG. 7, illustrating the manner in which the disengagement tool of FIG. 11 is used to disengage the panel assembly from the support structure.

When a panel assembly 30 is to be disengaged from the support structure 52, the actuator arm 72 is inserted between the lip section 38 of a panel 34 and the support structure flange 60 (see FIG. 12). The leading or outer end of the actuator arm 72 engages a retainer clip 40. Force is manually applied to the handle 70 to cause the actuator arm 72 to press against the retainer clip 40 and again resiliently flex the panel 34 and retainer clip 40 to move the latch teeth 44 and 46 out of engagement with the support structure 52.

Panel Assembly

The panel assembly 30 (FIG. 2) includes the panel 34 and retainer clips 40. The panel 34 is formed as a single piece of material. The panel 34 could be formed of any desired material. However, it is preferably fiberglass. Other known sound absorbing materials could be used if desired.

In one specific embodiment of the panel 34, the flat square lower major side surface of the base section 36 and lip section 38 was covered with a layer 76 (FIG. 3) of fabric. The layer 76 of fabric extended across the lower side surface of the panel 34 and upwardly across minor side surfaces 80 and 82 of the lip section 38. The fabric was folded over onto a flat upper major side surface 84 of the lip section 38. Of course, fabric covering 76 could be omitted if desired.

The rectangular lip section 38 is formed as one piece with the base 34. However, the lip section 38 has a thickness which is approximately one-half the thickness of the base section 36. The rectangular lip section 38 extends around the base 36 and forms a continuous rectangular frame for the base.

Figure 3:
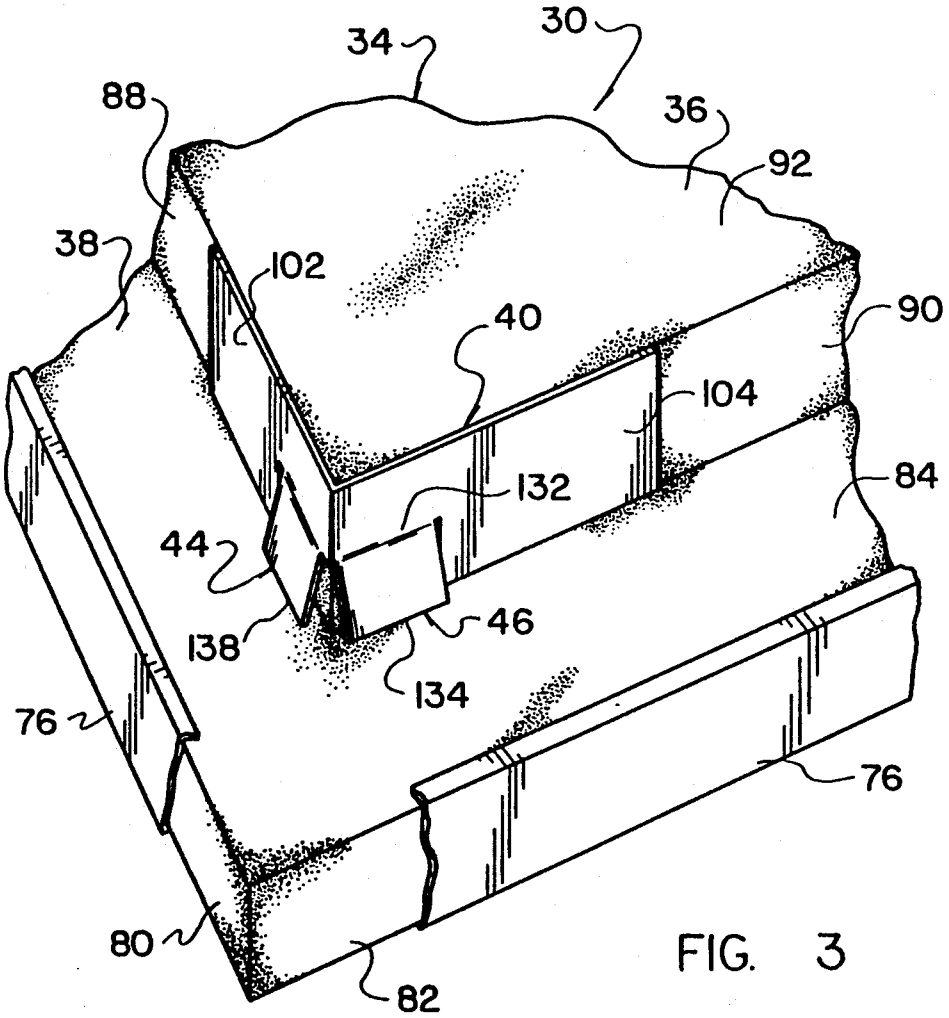
FIG. 3 is an enlarged pictorial illustration of a corner portion of the panel assembly of FIG. 2 and illustrating the manner in which a retainer clip is mounted on a panel.

The lip section 38 has a flat continuous bottom or lower (as viewed in FIG. 3) major side surface. The lower major side surface of the lip section 38 is coplanar with a flat bottom or lower major side surface of the base section 36. The flat upper major side surface 84 of the lip section 38 extends parallel to the flat lower major side surface of the lip section. The minor side surfaces 80 and 82 of the lip section 38 form a portion of a rectangular array of minor side surfaces which extend perpendicular to the major side surfaces of the lip section. The minor side surfaces of the lip section are uniformly spaced from upwardly extending minor side surfaces 88 and 90 of the base section 36 (FIG. 3).

A flat upper (as viewed in FIG. 3) major side surface 92 of the base section 36 extends parallel to the flat upper side surface 84 of the lip section 38 and to the coplanar flat lower major side surfaces of the base section 36 and lip section 38. The four minor side surfaces, including the minor side surfaces 88 and 90, of the base section 36 intersect at right angles to form corner portions of the base section 36 The minor side surfaces 88 and 90 of the base section 36 extend parallel to corresponding minor side surfaces, including the minor side surfaces 80 and 82, of the lip section 38.

In one specific embodiment of the panel 34, the base section 36 was a square with a length of approximately 24 inches along each side of the base section. The lip section 38 was also a square, in this specific embodiment of the panel 34, and had a length of approximately 25 inches along each of the outer side surfaces 80 and 82 of the lip section. The minor side surfaces 80 and 82 of the lip section 38 of this specific embodiment of the panel 34 were spaced approximately one-half inch from the minor side surfaces 88 and 90 of the base section 36. The foregoing dimensions for one specific embodiment of the panel 34 have merely been set forth for purposes of clarity of description and it is contemplated that the panel 34 may be formed with dimensions different than these specific dimensions. Of course, the panel 34 could have a configuration other than the square configuration described herein.

Retainer Clip

An improved retainer clip or element 40 (FIGS. 4–6) is mounted at each of the four corners (FIG. 2) of the panel assembly 30. The retainer clips or elements 40 all have the same construction and cooperate with the panel 34 and support structure 52 in the same manner. The retainer clips 40 engage the support structure 52 to hold the panel in place. The retainer clip 40 is resiliently deflected during installation of a panel assembly. In addition, the panel 34, itself, is resiliently deflected during installation. The retainer clip 40 (FIGS. 4–6) is formed as a relatively stiff, one-piece stamping formed from sheet steel having a thickness of 0.010 to 0.015 inches. Of course, a different metal having the same or a different thickness could be used if desired. The retainer clip 40 includes a pair of rectangular side walls 102 and 104 which extend perpendicular to each other (FIG. 5). The side walls 102 and 104 have flat major inner side surfaces which abuttingly engage the minor side surfaces 88 and 90 of the base section 36 (FIG. 3).

The side walls 102 and 104 of the retainer clip 40 extend from the upwardly facing (as viewed in FIG. 3) major side surface 84 of the lip section 38 to the flat upwardly facing upper major side surface 92 of the base section 36. In addition, the retainer clip 40 extends around the apex of a corner of the base section 36. Although the side walls 102 and 104 could be formed with any desired length, the specific retainer clip 40 used with the previously described specific embodiment of the panel 34 had side walls 102 and 104 with a length of approximately one inch.

The mounting teeth 48 and 50 extend inwardly from and perpendicular to the side walls 102 and 104. The mounting teeth 48 and 50 are connected to the lower edge portion of the side walls 102 and 104. The mounting teeth 48 and 50 have flat upper major side surfaces 108 and 110 (FIGS. 5 and 6) which are disposed in a coplanar relationship (FIG. 6). In addition, the mounting teeth 48 and 50 have flat lower major side surfaces 112 and 114 which are disposed in a coplanar relationship and extend parallel to the upper major side surfaces 108 and 110. The major side surfaces 108, 110 and 112, 114 of the mounting teeth 48 and 50 extend perpendicular to the side walls 102 and 104 of the retainer clip 40.

The mounting tooth 48 has a linear outer edge 116 (FIG. 5) which extends outwardly from and perpendicular to the side wall 102. A linear inner edge 118 of the mounting tooth 48 extends outwardly from the side wall 102 at an angle of approximately 45° (FIG. 5). The linear outer and inner edges 116 and 118 intersect at a point 120.

Similarly, the mounting tooth 50 has a linear outer edge 124 which extends inwardly from the lower portion of and perpendicular to the side wall 104. A linear inner edge 126 on the mounting tooth 50 extends at an angle of 45° to the side wall 104. The outer and inner edges 124 and 126 of the mounting tooth 50 intersect at a point 128.

The inner edges 118 and 126 of the mounting teeth 48 and 50 extend parallel to each other. The outer edges 116 and 124 of the mounting teeth extend perpendicular to each other. The specific retainer clip 40 used with the previously described specific embodiment of the panel 34 had linear edges 116 and 124 of the mounting teeth 48 and 50 with a length of approximately one-half of an inch. Of course, the retainer clip 40 could be constructed with mounting teeth 48 and 50 having different dimensions if desired, therefore, the foregoing specific dimensions of the retainer clip 40 are set forth only for purposes of clarity of description.

The latch teeth 44 and 46 extend outwardly from the side walls 102 and 104 in the opposite direction from the mounting teeth 48 and 50. Thus, the latch teeth 44 and 46 slope outwardly from the side walls 102 and 104 while the mounting teeth 48 and 50 extend inwardly from the side walls.

The latch teeth 44 and 46 are formed on opposite sides of and directly adjacent to the apex of a corner portion of the mounting clip 40 (FIG. 5). The latch tooth 44 extends outwardly from the side wall 102. Similarly, the latch tooth 46 extends outwardly from the side wall 104. The latch teeth 44 and 46 are spaced apart from each other at the corner (FIG. 3) of the retainer clip 40. Thus, the latch teeth 44 and 46 are not interconnected other than through the intersection of the side walls 102 and 104 at the corner of the retainer clip 40.

The latch tooth 46 flares outwardly from a fixed upper end portion 132 (FIGS. 3 and 4) which is integrally formed with the side wall 104. The latch tooth 46 has a free lower end portion 134 which extends parallel to the fixed upper end portion 132. The free lower end portion 134 of the latch tooth 46 is disposed outwardly from the side wall 104 (FIG. 6) to facilitate engagement of the free end portion of the latch tooth with a support structure.

The straight lower end portion 134 of the latch tooth 46 is spaced from the lower edge portion of the side wall 104 by a distance which is equal to the thickness of the portion of the support structure to be gripped between the latch tooth 46 and the upper major side surface 84 (FIG. 3) of the lip section 38. The lower edge portion 134 of the latch tooth 46 extends parallel to the upper major side surface 84 of the lip section 38. This construction allows the latch tooth 46 to be relatively rigid vertically and yet readily deflected horizontally from the normal position shown in FIGS. 3-6.

The latch tooth 44 has the same construction as the latch tooth 46. However, the latch tooth 44 projects from the side wall 102. The lower edge portion 138 of the latch tooth 44 (FIGS. 3 and 6) is disposed in the same level as the lower edge portion 134 of the latch tooth 46. Therefore, the straight lower edge portions 138 and 134 of the latch teeth 44 and 46 are spaced the same distance from the upper major side surface 84 of the lip section 38.

To mount the retainer clip 40 on the panel 34, the flat bottom or lower major side surfaces 112 and 114 of the mounting teeth 48 and 50 are placed on the upper major side surface 84 of the lip section 38. The corners 120 and 128 of the mounting teeth 48 and 50 engage the side surfaces 88 and 90 of the base section 36 at equal distances from the apex of the corner of the base section at the junction between the upper side surface 84 of the lip section 38 and the side surfaces 88 and 90 of the base section. The retainer clip 40 is then manually pressed or forced inwardly into the base section 36.

As the retainer clip 40 is pressed into the base section 36, the pointed ends 120 and 128 of the mounting teeth 48 and 50 pierce material of the base section. As the mounting teeth 48 and 50 penetrate into the base section 36, the side walls 102 and 104 move toward the side surfaces 88 and 90 of the base section. Continued inward movement of the retainer clip 40 move the side walls 102 and 104 into flat abutting engagement with the side surfaces 88 and 90 of the base section 36. At this time, the latch teeth 44 and 46 project outwardly over the upper side surface 84 of the lip section 38 in the manner shown in FIG. 3.

Method of Mounting the Panel Assembly

The panel assembly 30 is used to block a square opening 54 (FIG. 8) in the support structure 52. The square opening 54 in the support structure 52 is slightly larger than the base section 36 of the panel assembly 30. Thus, for the specific embodiment of the panel 34 previously discussed, the opening 54 in the support structure 52 would be square and would have a length along each of its sides of slightly more than 24 inches. Of course, different size panels 34 would be mounted in different size openings 54.

Since the size of the opening 54 in the support structure 52 is just slightly larger than the base section 36 of the panel 34, the base section of the panel 34 could be easily positioned in the opening, if the retainer clips 40 were omitted. However, the latch teeth 44 and 46 on the retainer clips 40 project outwardly from the sides of the base section 36. Therefore, the retainer clips 40 prevent the panel assembly 30 from merely being raised straight upwardly into the opening of the support structure.

When the panel assembly 30 is to be installed into an opening 54 in the support structure, the panel assembly is aligned with the opening. A first one of the corners of the panel assembly is then inserted into the opening 54. As this occurs, the portion of the lip section 38 adjacent to the first one of the corners engages the support structure 52. This portion of the lip section 38 is resiliently deflected through a relatively small distance as the latch teeth 44 and 46 on the retainer clip at the first corner of the panel assembly 30 engage the support structure 52.

The next corner portion of the panel assembly 30 is then inserted into the opening 54. Thus, the corner portion adjacent to the first corner portion is moved into the opening 54. The latch teeth 44 and 46 on the retainer clip 40 at this corner portion can not enter the opening 54. Therefore, the panel assembly 30 is resiliently flexed, in the manner shown in FIG. 8, to form a single upwardly projecting bend 56.

In the specific embodiment of the panel 34 previously described, the bend 56 extended at an angle of approximately 45° to the outer side surfaces 88 and 90 of the base section 36. The bend 56 was located approximately four inches from the corner portion of the base section 36 along each of the side surfaces 88 and 90. Of course, the specific location of the bend 56 (FIG. 8) resulting from resilient flexing of the panel assembly 30 will depend upon the location where force is manually applied to the panel assembly to resiliently deflect the panel assembly.

As the second corner portion is moved upwardly, the lip section 38 of the panel assembly 30 is pressed against the support structure 52. The lip section 38 is resiliently deflected to form the downward bend 64 in the manner illustrated in FIG. 9. As the bend 64 is formed, the latch teeth 44 and 46 move upwardly above the flanges 60 on the support structure 52. When the manual force which resiliently flexes the panel assembly 30 is released, the natural resilience of the panel 34 causes the base section 38 to move through a short distance relative to the support structure 52. As this occurs, the latch teeth 44 and 46 move into engagement with upper side surfaces of flanges 60 to grip the flanges between the latch teeth and the base section 38 of the panel 34. The remaining two corner portions of the panel assembly 30 are then sequentially positioned relative to the opening 54 in the support structure 52 and are resiliently flexed in the manner previously explained.

During installation of the panel assembly 30, there is little or no flexing of the retainer clips 40 at the first three corner portions of the panel assembly. Only the clip 40 at the fourth and final portion of the panel assembly 30 is flexed more than a minimal amount. Thus, as the first corner portion of the panel assembly 30 is installed, the clip 40 at this corner portion slips over the outwardly extending flange 60 on a grid member 62 of the support structure 52. The clips 40 at the next or second corner portion may be slightly flexed due to the somewhat greater resistance to installation of this corner. The clip at the next or third corner portion will probably be slightly flexed during installation of the third corner portion. When the clip 40 at the last or fourth corner portion is moved into engagement with the support structure 52, the clip is almost always at least slightly deflected due to a snapping action in engaging the flange 670.

Although the previously described method installing the panel assembly 30 is preferred, other methods of installing the panel assembly could be utilized if desired. For example, the panel assembly 30 could be aligned with an opening 54 in the support structure 52. Force would then be manually applied against the center portion of the panel 34 to resiliently deflect the panel upwardly into the opening 54. However, due to the outwardly projecting latch teeth 44 and 546 on the clips 40, all or at least some of the corner portions would not snap in place even though the panel 34 is resiliently flexed by pressure at the center portion of the panel.

To engage the support structure 52 with the mounting clips 40, upward force is manually applied against each of the corner portions of the panel 34 in turn. The upward force at each corner portions of the panel 34, increases the deflection of the panel at that corner portion. In addition, the upward force causes the clip 40, at the corner portion where the force is being applied, to resiliently deflect to some extent. As this occurs, the clip 40 snaps into place.

The natural resilience of the panel 34 causes the panel to assume its initial or undeflected condition with the retainer clips 40 engaging the support structure 62. This occurs with only minimal resilient flexing the latch teeth 44 and 46 of the retainer clips 40. Since the latch teeth 44 and 46 of the retainer clips 40 do not have to be flexed through a large distance as the panel 34 is installed, the latch teeth can have a construction which is horizontally flexible yet vertically rigid. This enables them to firmly grip the support structure 52 and hold the panel assembly 30 firmly in place. If the panel assembly 30 was installed by flexing only the latch teeth 44 and 46 on the retainer clips 40, the latch teeth would have to be relatively weak so that they could be deflected through a substantial distance as the panel assembly is pressed into the opening. This would substantially impede the obtaining of a secure connection between the panel assembly and the support structure. It could similarly impede the strength and durability of the panel/clip connection.

Conclusion

The present invention relates to a new and improved panel assembly 30, retainer clip 40 used in the panel assembly, and method of mounting the panel assembly. The panel assembly 30 includes a resiliently deflectable panel 34. One specific embodiment of the panel 34 includes a rectangular base section 38 and a rectangular lip section 36 which extends outwardly from the base section. An improved retainer clip 40 is mounted at each of the corners of the base section 36.

When the panel assembly 30 is to be installed in a support structure 52, the retainer clips 40 are moved into engagement with the support structure with minimal deflection of the retainer clips. This is accomplished by resiliently flexing the panel 34 to position the retainer clips 40 relative to the support structure 52. The resiliently deflectable panel 34 is released and its own natural resilience move the retainer clips 40 into engagement with the support structure. As this occurs, there may be some deflection of the retainer clips 40, themselves. Thus, the panel assembly 30 is mounted in the support structure 52 by deflecting the panel 34 itself and, to a lesser extent, the retainer clips 40.

Having described one specific preferred embodiment of the invention, the following is claimed:

1. A method comprising the steps of providing a panel having a plurality of retaining elements, aligning the panel with an opening in a support structure, and engaging the support structure with the retaining elements to hold the panel against movement relative to the support structure, said step of engaging the support structure with the retaining elements including resiliently flexing the panel.

2. A method as set forth in claim 1 wherein said step of resiliently flexing the panel includes deflecting a corner portion of the panel toward the support structure to move a retaining element connected with the corner portion of the panel relative to the support structure.

3. A method as set forth in claim 1 wherein said step of engaging the support structure with the retaining elements is performed with minimal deflection of the retaining elements.

4. A method as set forth in claim 1 wherein said step of resiliently flexing the panel includes deflecting a corner portion of the panel toward the support structure while maintaining a portion of the panel in an undeflected condition.

5. A method as set forth in claim 1 wherein said step of resiliently flexing the panel includes deflecting a portion of the panel under the influence of force applied against the panel by the support structure.

6. A method as set forth in claim 1 wherein said step of resiliently flexing the support panel includes deflecting a portion of the panel toward the support structure, pressing the portion of the panel which is deflected toward the support structure against the support structure, and further deflecting the panel under the influence of force applied against the panel by the support structure.

7. A method as set forth in claim 1 wherein the panel includes a plurality of corner portions with a main body portion disposed between and separating the corner portions, said step of resiliently flexing the panel includes deflecting each of the corner portions relative to the main body portion of the panel.

8. A method as set forth in claim 1 wherein said step of providing a panel includes providing a panel having a plurality of corner portions each of which is at least partially defined by the intersection of a pair of side surface areas, each of the retaining elements having a first latch tooth disposed adjacent to a first one of the side surface areas and a second latch tooth disposed adjacent to the other side surface area, said step of engaging the support structure with the retaining elements including gripping a portion of the support structure between a portion of the panel and a latch tooth while the panel is moving from a resiliently deflected condition to an undeflected condition under the influence of the natural resilience of the panel.

9. A method as set forth in claim 1 wherein said step of resiliently flexing the panel includes resiliently deflecting a portion of the panel, said step of engaging the support structure with the retaining elements including releasing a portion of the panel for movement relative to the support structure from a deflected condition to an undeflected condition under the influence of the natural resilience of the panel, and moving a retaining element along a first side surface area of the support structure and moving a surface area on the panel along a second side surface area of the support structure opposite from the first side surface area during movement of the panel from the deflected condition to the undeflected condition.

10. A method as set forth in claim 1 further including the step of disengaging the retaining elements from the support structure to release the panel for movement away from the support structure by again resiliently flexing the panel.

* * * * *